United States Patent [19]

Goldy et al.

[11] 4,449,716

[45] May 22, 1984

[54] TRAINING DEVICE FOR ATHLETES

[76] Inventors: Robert I. Goldy, 61 W. 62nd St., Apt. 17H, New York, N.Y. 10023; R. Clyde Herrick, 1707 Penns La., Ambler, Pa. 19002

[21] Appl. No.: 426,656

[22] Filed: Sep. 29, 1982

[51] Int. Cl.[3] ..... A63B 7/00

[52] U.S. Cl. ..... 272/109; 254/398; 272/24; 272/61

[58] Field of Search ..... 272/21, 24, 61, 62, 272/70, 109; 254/391-394, 398; 434/247

[56] References Cited

U.S. PATENT DOCUMENTS 3,476,385 11/1969 Foy ..... 272/24
4,125,257 11/1978 Lew ..... 272/109
4,410,175 10/1983 Shamp ..... 272/109

FOREIGN PATENT DOCUMENTS 137956 3/1979 Denmark ..... 272/109
222225 7/1968 U.S.S.R. ..... 272/61

*Primary Examiner*—Richard J. Apley
*Assistant Examiner*—S. R. Crow
*Attorney, Agent, or Firm*—Richard D. Weber

[57] ABSTRACT

A device for training athletes in gymnastics, acrobatics and the like comprising a spotting rig wherein the slack in the gymnast's suspension lines is automatically removed by a take-up mechanism. In a preferred form, the take-up mechanism includes a pair of connected swinging arms having sheaves at their free end. The arms are spring loaded so as to urge their ends away from each other, and the suspension line slack is accumulated between the sheaves. A brake mechanism is provided to slow or stop the motion of the arms and thereby retard or arrest the downward movement of the gymnast.

11 Claims, 6 Drawing Figures

TRAINING DEVICE FOR ATHLETES

BACKGROUND OF THE INVENTION

The present invention relates generally to devices for training athletes in gymnastics, acrobatics and other athletic activities and relates more particularly to a spotting rig for use with a trampoline, or other types of equipment or in floor exercises. Although the invention is useful for training acrobats, divers, circus performers, stunt skiers (snow and water) dancers and the like, it is primarily intended for use in training gymnasts and is accordingly described in that context.

In gymnastic exercises involving somersaults and other types of maneuvers where the gymnast's hands or feet leave their supporting surface, there is a risk that the gymnast may, due to faulty technique or other reason, land on the supporting surface in such a manner as to produce serious injury. This is true of floor exercises and particularly those performed on equipment such as a trampoline, balance beam, parallel bars and horizontal bar where the participant may be falling from a considerable height.

Training devices known as spotting rigs are commonly used both as a guard against injuries as well as to provide physical and psychological support to the gymnast when learning new exercises.

One simple form of spotting rig which is widely used comprises a belt secured to the gymnast's hips and connected at each side by a line passing over an overhead pulley. The instructor, known in this role as a "spotter", holds the other end of each line, manually taking up slack as the gymnast rises and falls above the exercise surface. If the spotter believes a gymnast to be in difficulty, sufficient force can be applied to the lines to slow or arrest the gymnast's descent until a safe attitude can be achieved. For example, in a somersault exercise where the gymnast achieved insufficient height to permit completion of the maneuver, the spotter can, by applying suitable force to the lines, provide a sufficient delay of the descent to permit completion of the maneuver, or if this is not possible, to at least avert an injurious landing.

In a modified form of the described spotting rig, the spaced pulleys which guide the lines are mounted on tracks which permit the gymnast to move beneath and parallel to the tracks, for example while executing a tumbling routine. With such an arrangement, the spotter must also move with the gymnast, taking up slack as required and being continually alert to the possible need for fall-preventing forces on the control lines.

Although the simpler form of belt for use with such spotting systems permits mainly forward and backward rotation, a more complicated belt permits both twisting and rotational movements of the gymnast.

Since the described types of conventional spotting rigs can only be safely used with the assistance of an experienced spotter who must be continually vigilant and react decisively should a dangerous situation threaten to develop, it can be appreciated that efforts have been made to develop a system which will provide safety and instill confidence but without the need for continuous monitoring by experienced personnel. In one known approach to this problem, a system has been devised wherein the gymnast's belt is attached to lines which are resiliently suspended from above so as to maintain a constant upward force on the belt. The device can be used without a spotter, since it is arranged to prevent gymnasts from ever fully falling to the training surface. U.S. Pat. No. 2,107,377 discloses an apparatus of this type.

Although such a device can be used without a spotter, it produces an unnatural bouyancy which, although useful during initial training, requires a difficult transition to the free state. Furthermore, such devices do not adapt themselves for use on a trampoline where the vertical movements far exceed those generated from floor mats.

Trampolines present particularly difficult problems for a spotter since the gymnast is constantly involved in up and down movements and the spotter is required to continuously adjust the belt suspension lines to prevent undue slack from developing with the danger that the gymnast may become tangled in the lines. This constant adjustment of the suspension lines is not only very tiring for the spotter, but is actually quite difficult since the vertical movement of the gymnast changes in rate both during ascent and descent. A good spotter for such exercises is in constant demand and can become so tired in handling several participants that his ability to react properly in an emergency may become impaired.

Another problem which is especially pertinent to trampoline exercises is the weight relationship between the spotter and the gymnast. In attempting to arrest the fall of a descending gymnast, a spotter can be abruptly lifted off the floor, even if he should outweigh the gymnast because of the energy developed during the gymnast's descent. The spotter is accordingly subject to possible injury, at the very least by rope burns and the like with the conventional spotting rig.

BRIEF SUMMARY OF THE INVENTION

The present invention provides an apparatus connected with the belt suspension lines which automatically takes up slack in the lines and further provides a braking mechanism which can be actuated by the spotter with the application of a relatively small force. The spotter holds a single brake line and his primary duty is to actuate the brake line to arrest an errant gymnast.

In a preferred embodiment, the slack take-up mechanism includes a pair of spaced arms pivotally mounted at one end thereof to permit angular movement in a common plane. Linkage means may be provided connecting the arms to maintain essentially equal and opposite angular movement of the respective arms. Sheaves rotatably mounted at the free end of each arm serve as an accumulator for the suspension line, expanding the amount of line accumulated as the arms move apart. The arms are spring loaded to move away from each other to the degree necessary to pick up the slack in the suspension lines.

The brake mechanism in the preferred embodiment includes a brake tube pivotally secured to one of the arms The brake tube passes through a guide attached to the other arm. A braking collar on the guide includes an extending actuating arm to which is attached a brake line directed by means of a pulley to the spotter. The pulling of the brake line slows or stops the movement of the brake tube through the guide and consequently the movement of the arms, thereby slowing or preventing the outfeed of the suspension lines in response to a descending movement of the gymnast.

The spotter is thus relieved of the usual duties of taking up slack in the belt suspension line and holds only a single brake line which need only be actuated should a potentially troublesome situation arise. Because of the mechanical advantage obtained with the mechanism, the braking force on the brake line need only be a small fraction of the restraining force produced by the suspension lines on the gymnast. The spotter may thus very quickly and positively slow or arrest a gymnast's descent with the application of a relatively low force to the brake line.

It is accordingly a first object of the present invention to provide a spotting rig for gymnasts which automatically takes up slack in the belt suspension lines.

Another object of the invention is to provide a spotting rig as described, the operation of which is extremely simple and which provides an increased measure of safety for the gymnast.

Another object of the invention is to provide a spotting rig as described having a braking mechanism permitting the rapid and positive slowing or arresting of the gymnast's downward motion upon detection of an improper descending attitude by application of a relatively light brake actuating force.

Still another object of the invention is to provide a spotting rig as described which is suitable for gymnastic routines involving substantial vertical movement such as trampoline exercises.

A still further object of the invention is to provide a spotting rig as described of a relatively simple construction which can be economically manufactured.

Additional objects and advantages of the invention will be more readily apparent from the following detailed description of an embodiment thereof.

BRIEF SUMMARY OF THE INVENTION

Figure 1:
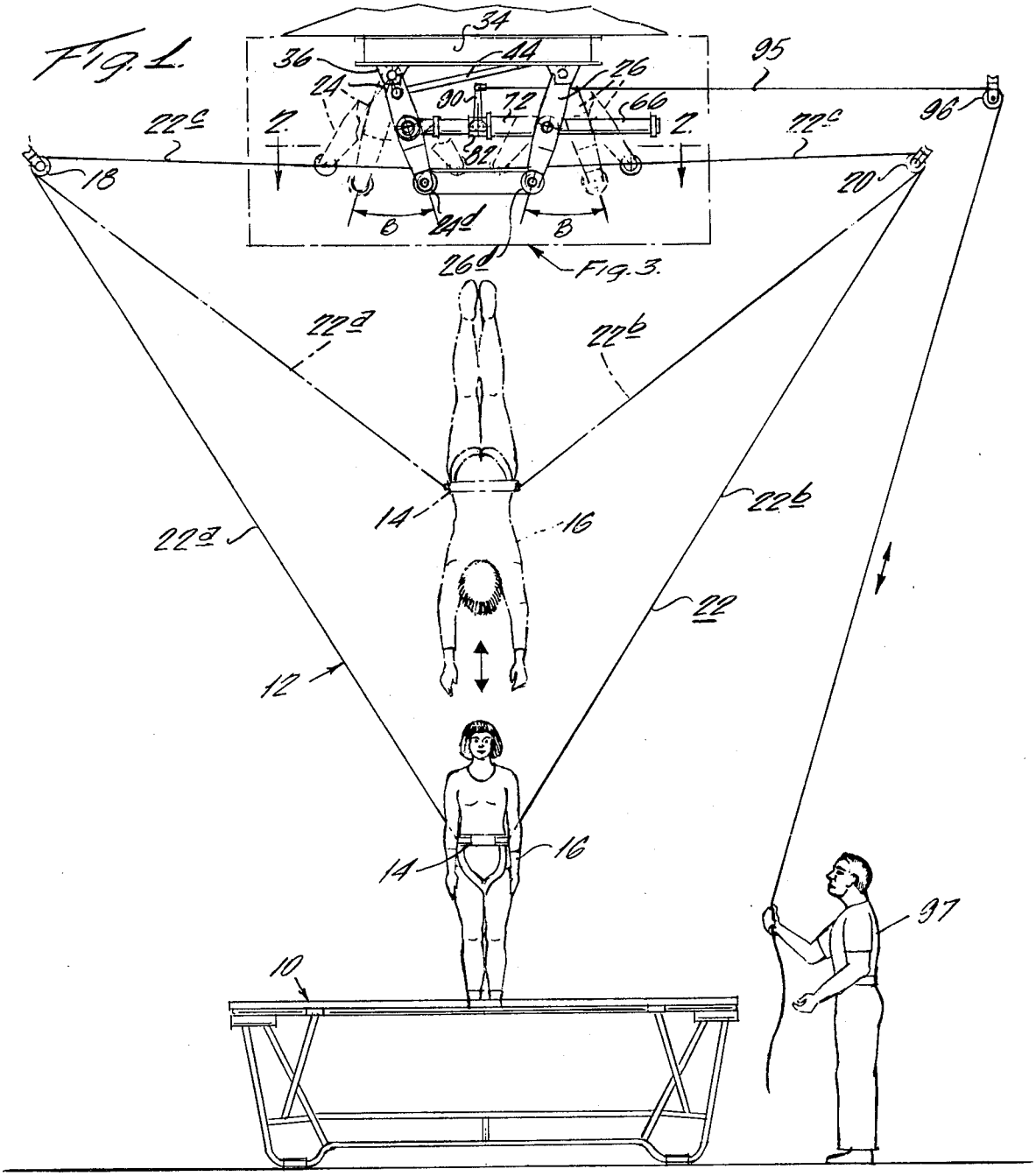
FIG. 1 is an end elevational view showing a trampoline equipped with a spotting rig in accordance with the present invention.
Figure 2:
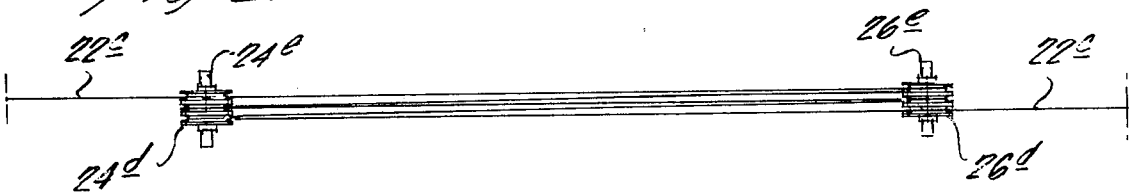
FIG. 2 is an enlarged partial view taken along line 2—2 of FIG. 1 showing the runs of the suspension line in the accumulator mechanism.

Referring to the drawings and particularly FIG. 1 thereof, a trampoline 10 of conventional construction is shown equipped with a spotting rig generally designated 12 in accordance with the present invention. The spotting rig includes a conventional tumbling belt 14 worn by the gymnast 16, a pair of spaced pulleys 18 and 20 secured to supporting means (not shown) above and to each side of the trampoline, a suspension line 22 passing through the pulleys 18 and 20 with the ends thereof attached to the sides of the belt 14. The belt 14, the pulleys 18 and 20 and their mounting location, and the connection of the downwardly extending portions **22*a* and 22*b* of the suspension line to the belt 14** are essentially a conventional arrangement.

In the usual spotting rig, the spotter holds the free ends of a pair of suspension lines, the opposite ends of each line being attached to the gymnast's belt. In the present rig, however, a single suspension line 22 is employed and means are provided for automatically taking up slack in the portions **22*a* and 22*b* of the line by accumulating the excess line in the portion 22*c* of the line between the pulleys 18 and 20. This means, as illustrated in the enlarged views of FIGS. 3 and 4, includes a pair of arms 24 and 26 which are respectively rotatably mounted on fixed shafts 28 and 30 for angular motion in a plane traversed by suspension line portion 22*c*. The shafts 28 and 30 are supported beneath spaced parallel frame members 32 and 34 by means of shaft support blocks 36** extending therebeneath.

The frame members 32 and 34 are joined by end frame members 38 and 40 to comprise a rectangular frame assembly which may be directly bolted to the ceiling of the room in which the gymnastic equipment is located or otherwise suspended in position, such as by means of a suitable framing system.

The arms 24 and 26 are each formed by spaced arm plates respectively designated **24*a*, 24*b*, 26*a* and 26*b*. The arm plates are maintained in spaced relation adjacent the pivot shafts by the respective hollow spacers 24*c* and 26*c* concentrically disposed with respect to the shafts. Bearing assemblies 42** on each arm plate provide a freely rotatable mounting of each arm with respect to its shaft.

The free ends of the arms 24 and 26 are provided with sheave assemblies **24*d* and 26*d* which are rotatably supported on bolts 24*e* and 26*e* passing through the ends of the arm plates. The sheave assemblies 24*d* and 26*d*, each of which in the illustrated embodiment accommodates three passes of the suspension line portion 22*c*, establish a means for accumulating the unneeded length of the line taken up as slack during the gymnast's ascent. The number of passes of the suspension line portion 22*c*** around the sheave assemblies is not critical, and although three are illustrated, another number of passes, such as four or five, may be equally suitable.

Means may be provided to insure that angular movement of one of the arms will result in essentially equal but opposite angular movement of the other arm. In the present embodiment, this means includes a connecting arm 44 terminating at its opposite ends in transverse cylindrical tubular members 46 and 48, the length of which are slightly less than the space between the arm plates of the arms 24 and 26. Shafts 49 and 50 passing respectively through the arms 24 and 26 and being secured in place therein by snap rings or other suitable fastenings, pass respectively through the tubular portions 46 and 48 of the arm 44 to provide a pivotal connection thereof to the arms. Shaft 49 is spaced the same distance beneath the shaft 28 of the arm 24 as the shaft 50 is spaced above the shaft 30 of arm 26, these distances being considered along the longitudinal axis of the arms. This relationship of the connection points of the arm 44 with the shafts 28 and 30 insures essentially equal and opposite angular movements of the arms 24 and 26. The pick up and release of slack in the suspension line 22 will thus occur essentially equally with respect to each line portion **22*a* and 22*b***.

In order to apply continuous tension to the suspension line 22 and accordingly pick up any slack which should develop therein, means are provided to provide a continuous rotational force on the arms 24 and 26. In the preferred embodiment, this means comprises a tension spring 52 secured at one end to a spring retaining shaft 54 extending between the frame members 32 and 34. The free end of the spring 52 carries a pulley 56 around which is passed a cable 58 fixed at one end to anchor 60 attached to frame end member 38, and connected at its opposite end to shaft 62 extending across the upper ends of arm 24 by means of the pivotal connector 64. The spring 52 accordingly exerts a continuous force on the upper end of the arm 24 serving to urge the arm 24 in the clockwise direction. By virtue of the interconnection of the arms 24 and 26 by connecting arm 44, the arm 26 will consequently be urged in a counterclockwise rotational direction. The spring 52 accordingly serves to bias the sheave assemblies **24*d* and 26*d*** away from each other, thus tending to increase the accumulated length of the suspension line between the sheaves as slack develops upon upward movement of the gymnast.

Figure 4:
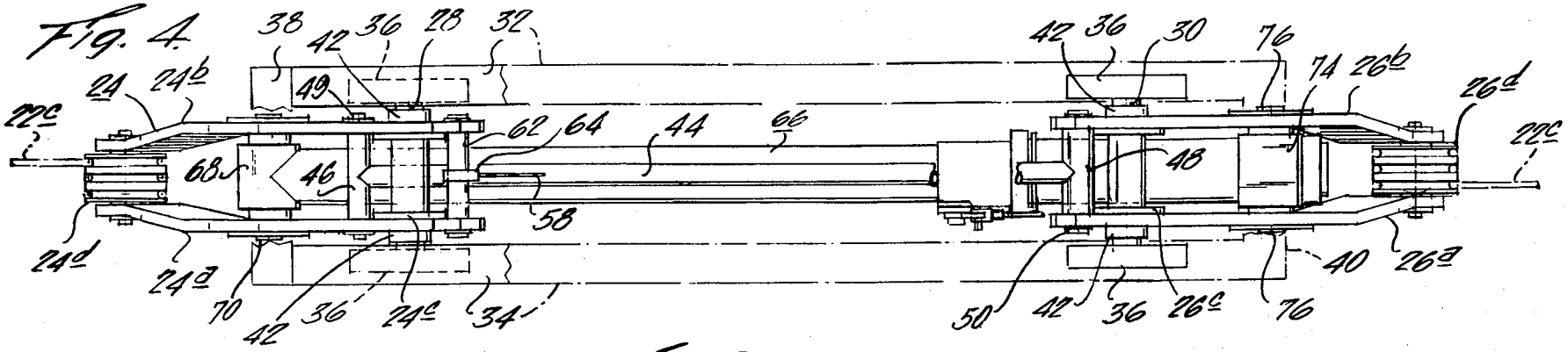
FIG. 4 is a view taken along line 4—4 of FIG. 3.
Figure 3:
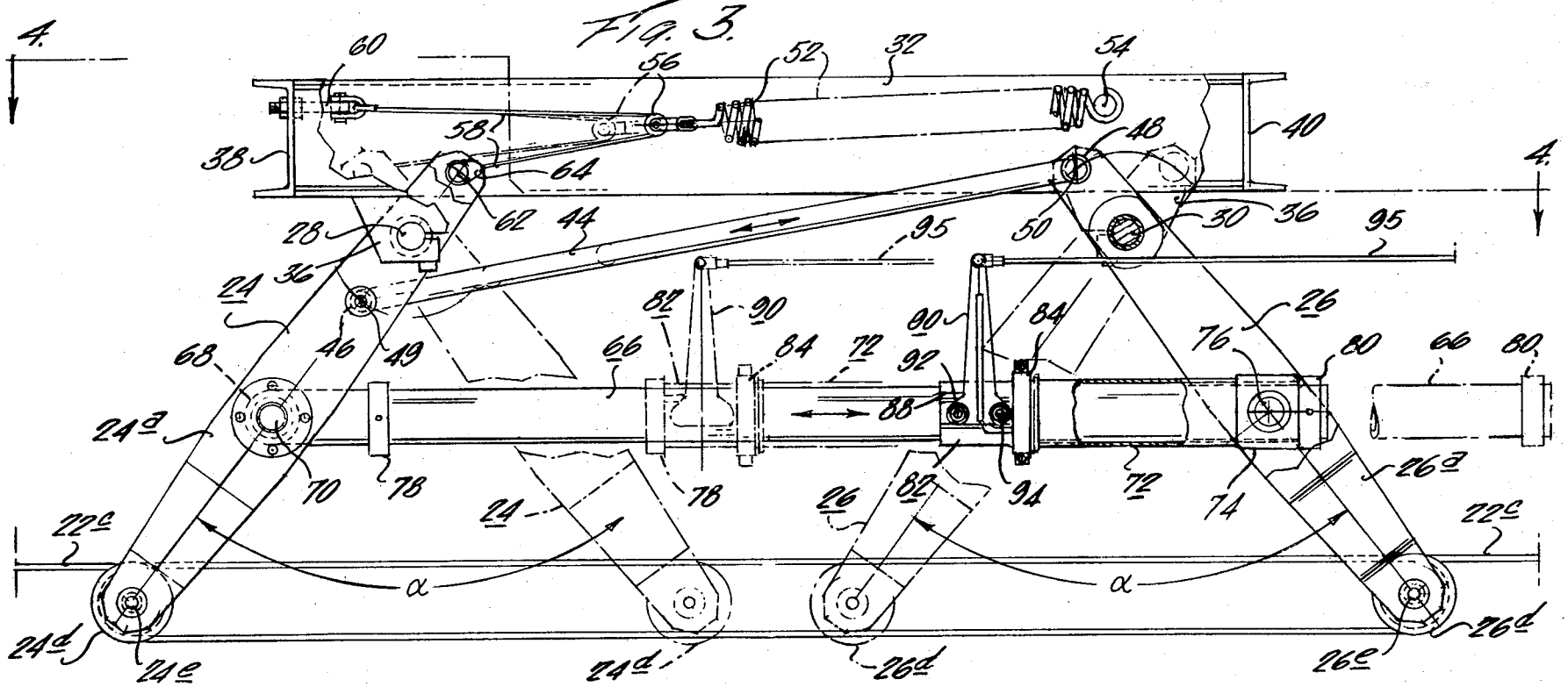
FIG. 3 is an enlarged elevational view of the slack take-up mechanism enclosed in dot/dash lines in FIG. 1.

In order to slow or stop the angular movement of the arms 24 and 26 and hence the descent of the gymnast in case of emergency, braking means are provided which can be remotely actuated by a spotter. Referring to FIGS. 3 and 4, the braking means in the illustrated embodiment includes a brake tube 66 which carries at one end a transverse cylindrical tube 68 through which passes a shaft 70 extending through the arm plates **24*a* and 24*b* of arm 24 approximately midway between the shaft 28 and the sheaves 24*d*. The brake tube is accordingly rotatably attached at one end to the midpoint of the arm 24 and is rotatable with respect thereto. The free end of brake tube 66 passes through a tubular guide 72 which is pivotally connected at one end to the approximate midpoint of the arm 26 by a hollow connector 74 having stub shafts 76 extending from each side thereof which pass through the arm plates 26*a* and 26*b* of arm 26. The guide 72 being of slightly larger diameter than the brake tube 66, the tube 66 can freely slide through the guide during movement of the arms 24 and 26. Stop collars 78 and 80 on the tube 66 serve as limits for the movements of the arms 24 and 26**.

Figures 5, 6:
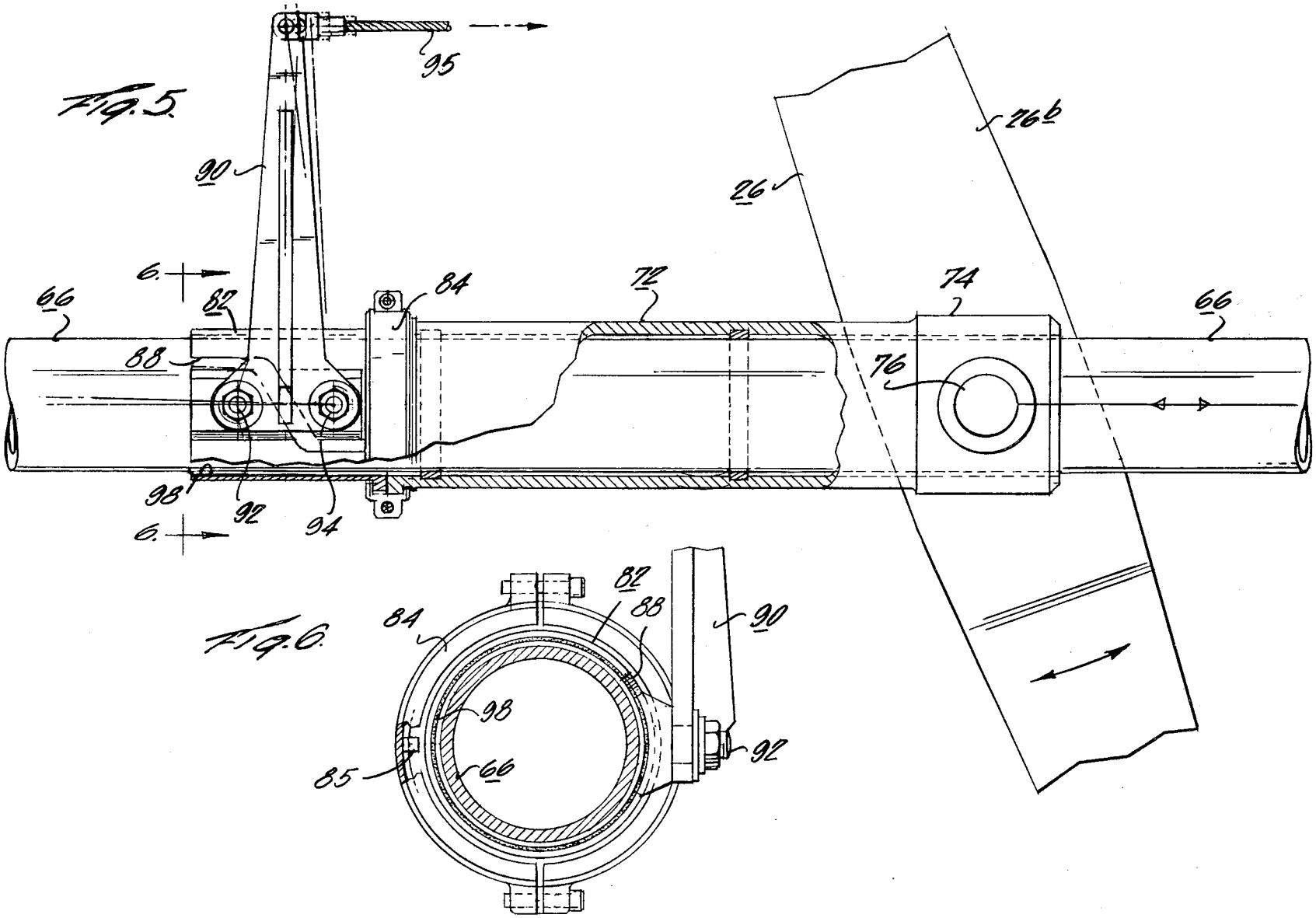
FIG. 5 is an enlarged elevational view of the brake mechanism.
FIG. 6 is a sectional view taken along line 6—6 of FIG. 5.

As shown most clearly in the enlarged views of FIGS. 5 and 6, a brake collar 82 riding on the brake tube 66 is connected by means of abutting flanges to the free end of the guide 72 by means of the split ring 84. Rotation of the brake collar is prevented by the key 85 passing through aligned keyways in the flanges of the collar 82 and guide 72.

The brake collar 82 is not circumferentially continuous, but is interrupted by a serpentine gap 88 which provides mutually offset adjoining portions of the collar. The lower end of a brake arm 90 is connected at axially spaced points 92 and 94 to the opposed offset portions of the brake collar 82. A brake line 95 attached to the upper end of the brake arm 90 and passing around pulley 96 fixed to a supporting structure (not shown) passes downwardly to the hands of a spotter 97 for selective actuation of the brake mechanism.

In this illustrated embodiment, the downward pull of the brake line 95 will rotate the brake arm 90 in a clockwise direction, thereby tightening the collar 82 around the brake tube 66 and frictionally resisting the telescoping movement of the brake tube 66 into the guide 72. A brake lining 98 providing a suitable frictional grip of the brake collar 82 is preferably bonded to the inner surface of the brake collar.

For use of the invention, the gymnast straps on the conventional tumbling belt 14 and, with the spotter 96 in position and holding the free end of the brake line 92, commences exercising. With each vertical movement of the gymnast, the slack take-up mechanism of the invention will automatically shorten the effective length of the suspension lines as illustrated for example in FIG. 1 in the broken line view wherein the gymnast has moved to an inverted elevated position. To accumulate the unneeded length of the line in this position, the arms 24 and 26 have moved through the angle B. Upon the return of the gymnast to the surface of the trampoline, the mechanism will return to its solid line position.

Since the guide 72, collar 82 and brake arm 90 are connected to the arm 26, they will be engaged in reciprocating horizontal movement coincident with the vertical movements of the gymnast. The brake line 92 held by the spotter must accordingly be raised and lowered in accordance with the gymnast's movements to maintain the line in a reasonably taut condition ready for brake actuation. As the gymnast goes up, the brake line is drawn down, and conversely, as the gymnast comes down the brake line is permitted to go up. The brake line need be moved only a fraction of the amount previously required of conventional spotting rigs, and little effort is required since the spotter is no longer operating the gymnast support lines. The movements of the brake line serve to keep the spotter attuned to the gymnast's movements and he is then able to react quickly and instinctively to apply a braking force when necessary.

In the event that the gymnast should be deemed by the spotter to be in a position which might result in an injurious fall, such as landing head first, the spotter simply pulls on the brake line 92, thereby actuating the braking mechanism to the degree necessary to slow or arrest the descent of the gymnast. The force required to actuate the brake lever is less than the restraining force produced on the gymnast due to the mechanical advantage achieved with the braking mechanism.

Although the present system does not remove the need for a spotter, the spotter's duties are greatly reduced and he will not suffer the fatigue characteristic of conventional systems, particularly when spotting a gymnast on a trampoline.

Although the slack take-up and braking mechanism is most suitably mounted above the exercise area, it could also be mounted beneath the trampoline with the suspension lines passing over the pulleys 18 and 20 and then downwardly to a second set of pulleys located on the floor. The brake line could then pass directly from the brake arm to the spotter. Alternately, a foot pedal or hand lever could be connected to the brake line for use by the spotter.

Although in the illustrated embodiment a single spring acting on arm 24 is utilized in conjunction with the connecting arm 44 to urge the free ends of the arms apart in a substantially equal manner, other arrangements could be utilized for this purpose. For example, separate springs could be employed acting on each arm 24 and 26 to carry out this function. With springs of substantially equal force, the connecting arm 44 would no longer be necessary, since it is not essential that the angular displacement of each arm 24 and 26 be precisely identical to that of the other.

Manifestly, changes in details of construction can be effected by those skilled in the art without departing from the spirit and scope of the invention.

We claim:

1. A training device for athletes for automatically taking up slack in and providing the braking force to the suspension line of a training rig, said device comprising a frame assembly, a pair of spaced arms, each of said arms rotatably mounted adjacent one end thereof to said frame assembly for angular motion in a common plane, means at the free end of each of said arms for receiving a portion of said suspension line and returning said portion toward said other arm biasing, means continuously acting on said arms tending to angularly separate the free ends of said arms, and braking means for selectively slowing or arresting the movement of said arms.

2. The invention as claimed in claim 1 wherein said means at the free ends of said arms for receiving a portion of said suspension line comprises a sheave assembly rotatably mounted on each arm.

3. The invention as claimed in claim 1 including means for providing opposite angular movement of said arms, said means comprising a connecting arm connecting said arms at points at opposite sides of the pivot points of said arms.

4. The invention as claimed in claim 3 wherein said biasing means for applying a force to said arms comprises spring means on said frame assembly connected to at least one of said arms.

5. The invention as claimed in claim 1 wherein said braking means comprises a member pivotally connected at one end to one of said arms and a guide receiving the free end of said member and pivotally connected to the other of said arms, and means on said guide for selectively frictionally restraining the free passage of said member through said guide.

6. The invention as claimed in claim 5 wherein said braking means includes a brake collar on said guide and and a brake arm for actuating said brake collar.

7. A spotting rig for training athletes at a training station comprising a belt adapted to be worn by the gymnast, a suspension line connected at each end thereof to said belt, means disposed above and to each side of the training station for receiving and changing the direction of said suspension line, slack take-up means operatively connected with the portion of said suspension line extending between said line receiving means, said slack take-up means applying a continuous tension to said suspension line to automatically take up slack therein, and braking means selectively actuatable to restrain or arrest the release of the suspension line from said slack take-up means.

8. The invention as claimed in claim 7 wherein said slack take-up means comprises a pair of arms rotatably mounted at one end thereof, sheave means on the free end of each said arm, and means for biasing said arms away from each other, the portion of said suspension line extending between said means for receiving and changing the direction of said suspension line passing around the sheave means of said arms for accumulation therebetween during rising movements of the gymnast.

9. The invention as claimed in claim 8 wherein said braking means comprises a member pivotally connected at one end to one of said arms and a guide receiving the free end of said member pivotally connected to the other of said arms, and means for selectively restraining the free passage of said member through said guide.

10. The invention as claimed in claim 9 wherein said braking means includes a brake collar on said guide and a brake arm for actuating said brake collar.

11. The invention as claimed in claim 8 including means for insuring a substantially equal and opposite angular movement of said arms.

* * * * *